US005974226A

United States Patent [19]

Shaffer

[11] Patent Number: 5,974,226

[45] Date of Patent: Oct. 26, 1999

[54] HEATED POWER CABLE

[76] Inventor: Brent Shaffer, 700 W. 41st Ave., Suite 101, Anchorage, Ak. 99503

[21] Appl. No.: 09/087,870

[22] Filed: Jun. 1, 1998

[51] Int. Cl.[6] ..... H05B 3/34

[52] U.S. Cl. ..... 392/301; 219/549; 219/548; 166/302

[58] Field of Search ..... 392/301, 305; 219/200, 523, 544, 552, 553; 174/102 R, 103, 138 J; 338/226; 166/302

[56] References Cited

U.S. PATENT DOCUMENTS 4,490,577 12/1984 Neuroth ..... 174/103
4,733,059 3/1988 Goss et al. ..... 219/548
4,864,107 9/1989 Boyal ..... 219/549
5,528,824 6/1996 Anthony et al. ..... 29/828
5,782,301 7/1998 Neuroth et al. ..... 166/302

*Primary Examiner*—Teresa Walberg
*Assistant Examiner*—Vinod D. Patel
*Attorney, Agent, or Firm*—Michael Tavella

[57] ABSTRACT

A heated power cable for oil wells providing controllable, variable power output and heater redundancy. Heating elements are electrically and thermally insulated within the same armor in a manner that permits the heating elements to direct heat to the oil in the well, while simultaneously protecting the power conductors from excess heat.

7 Claims, 3 Drawing Sheets

HEATED POWER CABLE

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to power cables having integral heater cables installed therewith and particularly to power cables having integral heaters for use in oil wells.

2. Description of Related art

When moving viscous oil from a well, particularly in shallow arctic oil wells, it is often beneficial to heat the oil to reduce its viscosity. To do this, a heater cable is installed in the well, along with a power cable that is run down the well to provide power to the submersible pump.

Heating circuits and power circuits typically have mutually exclusive design characteristics. Power cables are insulated with temperature sensitive materials and the power handling ability of these cables is temperature dependent. As a result, the common method of supplying power and heat to a well requires two penetrations in the well head; one for a power cable and one for an electric heater cable. This raises the cost of construction, and involves marking and monitoring two cables in the well.

BRIEF SUMMARY OF THE INVENTION

The instant invention combines the functions of power transmission and heating into one cable while improving heat transfer to the oil, while reducing heat loss to the casing. This new cable only requires one well head penetration and occupies less space in the well bore. Also, installation is simplified and costs reduced by using only one cable.

It is an object of this invention to combine the functions of power transmission and heating into one cable.

It is a further object of the invention to require only one well head penetration to power and heat the well.

It is another object of this invention to minimize space occupied in the well bore for the function of power transmission and heating.

It is yet a further object of the invention to reduce installation costs and complexity in the design of an oil well.

It is another object of this invention to provide improved heat transfer to the oil.

It is another object of this invention to minimize heat loss to the well casing and surrounding ground.

It is a further object of this invention to improve efficiency by making use of heat generated by the power cable.

It is yet a further object of this invention to produce a controllable, heated cable having multiple power outputs in one cable.

The invention consists of a cable that has a power cable section, an electric heater cable section, a layer of insulation, and a layer of armor protection. By combining the cables into one jacket, the installation is simplified because there is only one penetration. The cable takes up less space in the well. Less labor is needed for the installation. The cable saves material because there is less banding armor required for one cable. The single cable provides better heat transfer to the oil, while reduced heat loss to the casing and surrounding ground. Thus, overall operating efficiency is improved. Finally, the cable can be made using a variety of suitable materials and cables available from any cable manufacturer.

DETAILED DESCRIPTION OF THE INVENTION

Figure 1:
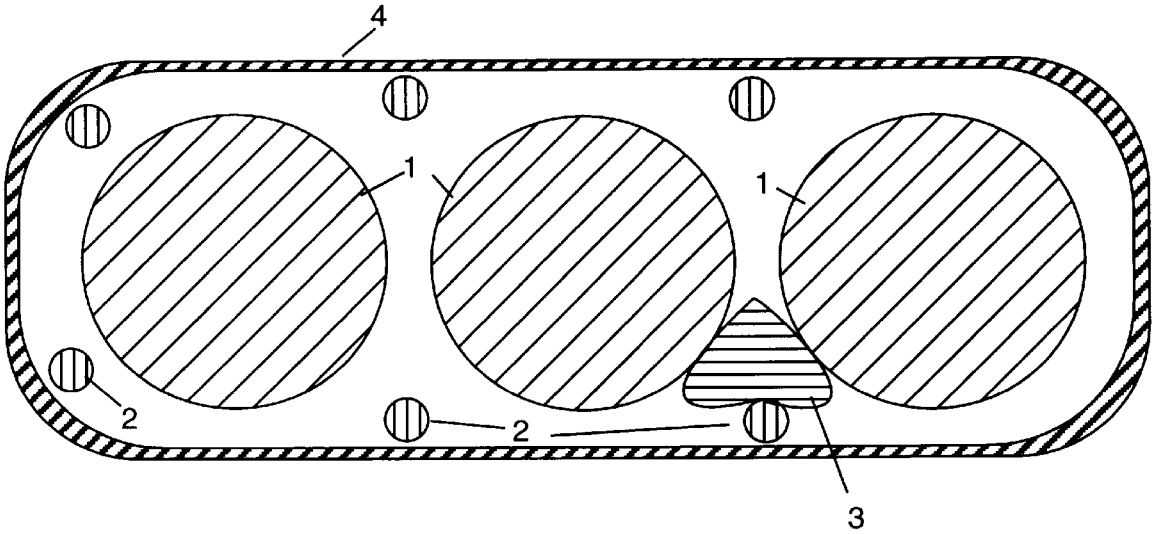
FIG. 1 is a cross section view of a flat heated power cable showing the key elements of this invention.

Referring to FIG. 1, a flat cable cross section is shown. The assembly includes an insulated metallic conductor 1 that serves as a power conductor, an insulated electrical, metallic heater 2, a layer of thermal insulation 3 that acts as a biasing element, and a covering of mechanical armor 4.

Figure 2:
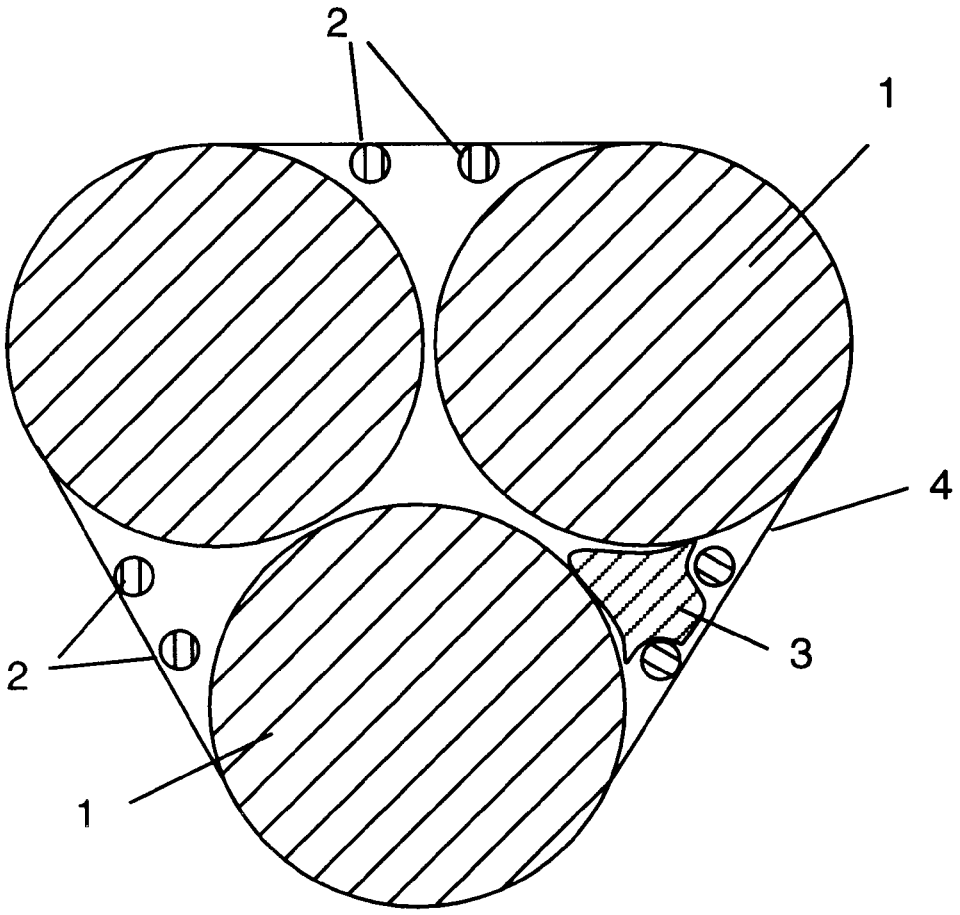
FIG. 2 is a cross section view of a round heated power cable, showing the key elements of this invention.

Similarly, FIG. 2, shows a type of heated power cable having a circular design. This figure shows the insulated metallic conductor 1, the metallic heater 2, a layer of thermal insulation 3 that acts as a biasing element, and a covering of mechanical armor 4. In this design, however, the elements are configured in a round or circular configuration.

In both embodiments, the insulated metallic conductor 1, is a type commonly used in the industry. The metallic heater 2 is designed for appropriate power output at available voltage. The thermal insulation 3 is formed around both the insulated metallic conductor 1 and the metallic heater 2 as shown. The thermal insulation 3 thermally isolates the heaters from the power conductors and biases the metallic heater 2 against the armor 4 as shown.

The cables are powered from outside the well and are fed into the casing to supply power to the submersible pump (not shown), using ordinary materials and techniques known in the industry.

Figure 3:
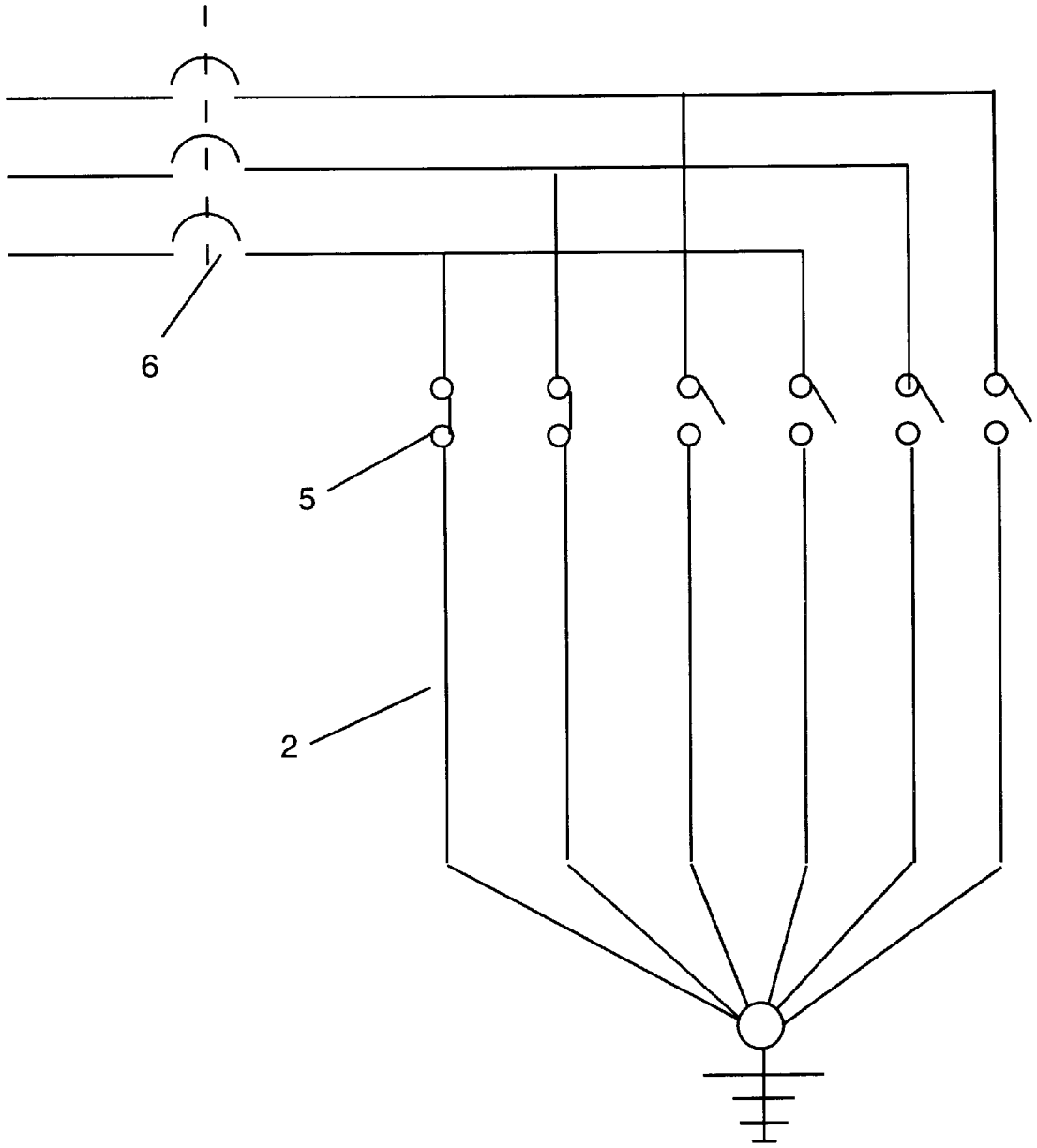
FIG. 3 is a schematic diagram of the heater power circuits showing the redundancy and controllability of the heaters.

FIG. 3 is a schematic of the heater circuits. The metallic heater 2 are connected to a power supply through switches 5 and circuit breakers 6 as shown. In use, the switches 5 can be closed to add more heat. In practice, the numbers of heater circuits are initially determined and the appropriate number of switches 5 are closed. The remaining metallic heaters 2 are spares and provide redundancy for the system.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A heated power cable comprising:

a) a insulated power conductor;

b) a layer of mechanical armor, formed around said insulated power conductor, thereby forming a tube about said insulated power conductor, said tube having an inside and a perimeter;

c) a heating element, placed inside tube, and being in proximity to said layer of mechanical armor;

d) a thermal insulating layer in mechanical communication with said heating element and said insulated power conductor, whereby said thermal insulating layer maintains thermal separation between said heating element and said insulated power conductor;

e) a biasing means, in mechanical communication with said heating element for biasing said heating element against said inside of said tube formed from said layer of mechanical armor, and further wherein said biasing means prevents electrical contact between said heating element and said insulated power conductor.

2. The heated power cable of claim 1 wherein the tube is a flattened cylinder.

3. The heated power cable of claim 1 wherein the tube forms a cylinder.

4. The heated power cable of claim 1 wherein the biasing means comprises the thermal insulating layer.

5. The heated power cable of claim 1 wherein the heating element comprises three pairs of resistive heat conductors.

6. The heated power cable of claim 5 wherein the three pairs of resistive heat conductors are spaced about the perimeter of the tube.

7. The heated power cable of claim 5 further comprising: a plurality of switches, each switch in electrical communication with one of each of the three pairs of resistive heat conductors, such that each pair of heat conductors can be energized or deenergized independently.

* * * * *